US006619628B1

(12) United States Patent
Steffes

(10) Patent No.: US 6,619,628 B1
(45) Date of Patent: Sep. 16, 2003

(54) PICKET FENCE CAP ASSEMBLY

(75) Inventor: Stephen W. Steffes, McPherson, KS (US)

(73) Assignee: CertainTeed Corporation, Valley Force, PA (US)

( * ) Notice: Subject to any disclaimer, the term of this patent is extended or adjusted under 35 U.S.C. 154(b) by 0 days.

(21) Appl. No.: 10/081,467

(22) Filed: Feb. 22, 2002

(51) Int. Cl.[7] ..... E04H 17/14

(52) U.S. Cl. ..... 256/1; 256/65.01; 256/19

(58) Field of Search ..... 256/65.01, 66, 256/1, 19, 11, 12, 24

(56) References Cited

U.S. PATENT DOCUMENTS 5,645,270 A * 7/1997 Lawrence ..... 256/66
2002/0104985 A1 * 8/2002 Lesenskyj ..... 256/65.1
2002/0104986 A1 * 8/2002 Lesenskyj ..... 256/65.1

OTHER PUBLICATIONS

Picket Fence Caps and Clips Product Literature, 2001 LMT–Mercer Group, Lawrenceville, New Jersey.
Picket Fence Caps and Clips Product Literature, TopCaps, Pompano Beach, Florida.

* cited by examiner

*Primary Examiner*—Lynne H. Browne
*Assistant Examiner*—John Cottingham
(74) *Attorney, Agent, or Firm*—John F. Letchford; Klehr, Harrison, Harvey Branzburg & Ellers LLP

(57) ABSTRACT

A clip-on assembly that can resist detachment of a plastic picket cap member from a plastic picket member when significant pulling force is applied to the cap member. The assembly includes a single clip including an upwardly bowed central portion joined to first and second upwardly extending end portions. The end portions have at least one outwardly projecting retention barb adapted for secure embedment into the inner side wall surfaces of a picket member when the assembly is inserted therein. The legs of the cap member upon which the clip is installed are very stiff by virtue of being reinforced by plates that resist deflection of the legs when inserted in the clip.

24 Claims, 2 Drawing Sheets

PICKET FENCE CAP ASSEMBLY

FIELD OF THE INVENTION

The present invention relates in general to fence structures and in particular to a picket fence structures.

BACKGROUND OF THE INVENTION

A wide variety of fencing structures have long been used to separate or enclose areas of industrial, commercial, residential and other properties. Common examples include stockade, chain link, wire, split rail and picket fencing. Fencing products may be fabricated from many different type of materials such as metal, wood, plastics and combinations or composites thereof. Among these, plastic and plastic-based fencing products are becoming increasingly popular. This is because they are relatively easy and inexpensive to manufacture and because consumers appreciate their attractiveness, low-maintenance, durability and competitive cost.

Plastic picket fencing represents a significant segment of the fencing industry. The pickets of a typical plastic picket fence are designed to resemble wooden pickets but are usually made from two pieces, the picket member and an upwardly pointed cap member that may be adhesively attached or mechanically fastened to the picket member. A disadvantage of using glue to attach the cap to the picket is that it can be messy and unsightly if applied improperly. Moreover, adhesives tend to become brittle and lose their bonding strength when exposed to the elements for extended periods of time. As such, after the passage of time it is not unusual for an adhesively attached cap to become relatively easily detachable from its picket. Such loosened caps can then become separated from their pickets by vandals or by something as benign as a strong wind, thereby leaving the fence in an incomplete, unsightly condition.

Mechanical fixation is an alternative to adhesive attachment of a plastic cap member to a plastic picket fence member. Mechanical fixation involves the creation of a friction or interference fit between the cap and picket members. Examples of picket fence cap assemblies that utilize such a friction fit principle are marketed by LMT Products Corporation ("LMT") of Lawrenceville, N.J. These assemblies comprise the cap member itself as well as a pair of stainless steel metal clips. The molded plastic cap member includes a plurality of downwardly depending legs that are adapted for insertion into the open top of a plastic picket. The picket is a typically a predetermined length of hollow extruded rigid polyvinyl chloride (PVC), polycarbonate, acrylic ester-modified styrene acrylonitrile terpolymer (ASA) or other plastic material having a rectangular cross sectional configuration designed to impart to the picket the shape of a wooden board or plank. Each of the metal clips includes a barb that functions to securely attach the clips to the cap member when the clips are press fitted onto the bottoms of legs disposed at opposite ends of the cap member. The clips include outwardly and upwardly inclined flat tabs or fingers that, when the cap member is inserted into the picket member, frictionally engage the inner surfaces of opposite end walls of the picket member. It is this frictional engagement of the clips with the picket member which serves to retain the cap member on the picket member.

As presently constructed, the LMT clip-on picket fence cap assemblies cap members can be extracted from their pickets by the exertion of about 8–15 lbs. tensile or pulling force. While this level of resistance is sufficient to prevent detachment of the cap member as a result of a strong wind, it would not be enough to deter a determined vandal.

An advantage exists, therefore, for a clip-on picket fence cap assembly that can resist detachment of a plastic picket cap member from a plastic picket member when significant pulling force is applied to the cap member.

SUMMARY OF THE INVENTION

The present invention provides a clip-on picket fence cap assembly that can resist detachment of a plastic picket cap member from a plastic picket member when significant pulling force is applied to the cap member. The assembly overcomes the deficiencies of existing products in several ways. First, the invention proposes a single clip constructed as a bow-like member. The clip comprises a bow-shaped central portion that is joined to first and second end portions that are preferably provided with at least one outwardly projecting retention means. The bow-shaped central portion exerts outward force on the end portions to cause the retention means to securely embed into the inner end wall surfaces of a picket member when the cap assembly is inserted therein. Additionally, the legs of the cap member upon which the clip is installed are very stiff by virtue of being reinforced by side extensions that resist deflection of the legs when inserted in the picket member. This is contrasted with conventional cap members whose unreinforced legs flex inwardly upon insertion into a picket, thereby inhibiting the metal tabs of the clips from "hooking" or "biting" into the inner walls of the extruded picket. The resultant assembly is substantially stiffer and stronger than presently available clip-on picket fence cap assemblies. Because of this, its clips very firmly embed themselves into a picket and make it very difficult to extract the cap from the picket by simply pulling on the cap.

Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments thereof shown, by way of example only, in the accompanying drawings, wherein.

DETAILED DESCRIPTION OF THE INVENTION

Figure 3:
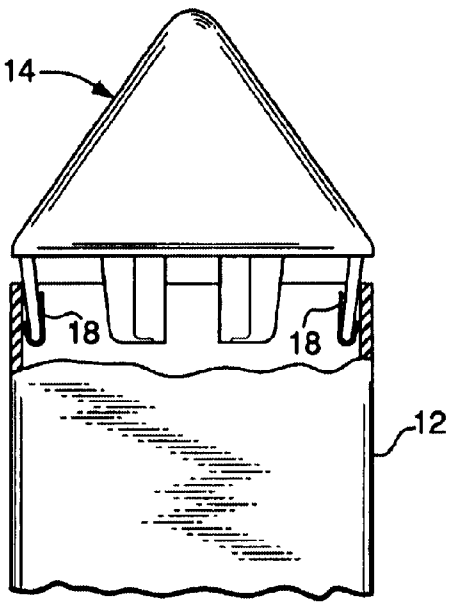
FIG. 3 (Prior Art)
FIG. 3 is a partially broken, side elevation view of the assembly of FIG. 2 installed in a plastic picket.

Referring to the drawings, wherein like references indicate like or similar elements throughout the several views, there is shown a conventional plastic fence picket 10 in assembled condition. Picket 10 includes a hollow, typically extruded, plastic picket member 12 and a molded plastic cap member 14. The picket member 12 may be of any desired length and may be square or, more commonly, rectangular in cross-section. It may have outer width and thickness dimensions ranging from about 1½ to about 6 inches in width and from about ¾ to about 1½ inches in thickness. The base of the top or finial portion of the cap member 14 normally corresponds in size and shape to the outer width and thickness dimensions of the picket member 12. And, the top or finial portion of the cap member 14 may be formed as a complete (as illustrated) or truncated upwardly tapering pyramid such that, when the cap member 14 is inserted into the picket member 12, the resultant picket 10 simulates the shape of a conventional wooden picket. As stated previously, cap member 14 may be adhesively attached to or clipped onto the picket member 12.

Picket member 12 and cap member 14 may be formed entirely of plastic such as PVC, polycarbonate, ASA polyvinyl chloride or other rugged plastics. Alternatively, they may be a composite of plastic and natural and/or artificial fibrous materials to enhance the strength and/or paintability of the products. As is known, the plastic may also include ingredients for promoting weather resistance, UV radiation resistance, mildew resistance, fading or discoloration resistance and/or for imparting other beneficial properties to the products.

Figure 2:
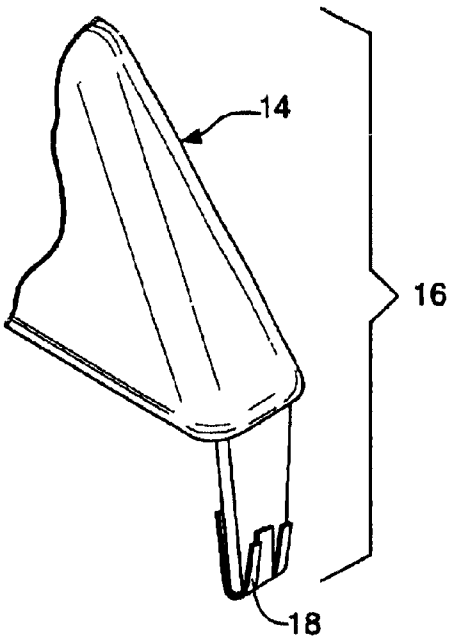
FIG. 2 (Prior Art)
FIG. 2 is an isometric view of a clip-on picket fence cap assembly known in the art.
Figure 1:
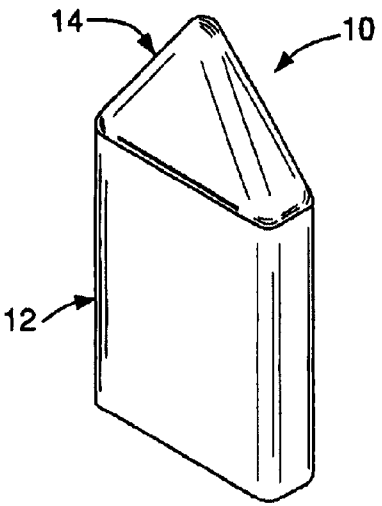
FIG. 1 (Prior Art)
FIG. 1 is an isometric view of a plastic fence picket in assembled condition.

FIGS. 2 AND 3 show the structural aspects of a conventional clip-on picket fence cap assembly 16 that is known in the art. Assembly 16 comprises a molded plastic cap member 14 that is affixable to an extruded plastic picket member 12 via a pair of metal clips 18. Clips 18 are typically fabricated from stainless steel or other corrosion-resistant metal or metal alloy. The cap member 14 includes a plurality of downwardly depending side legs 20 and end legs 22 that are adapted for insertion into the open top of picket member 12. Each clip 18 includes a substantially U-shaped central portion which is adapted to receive the bottom of a respective one of the end legs 22 disposed at opposite ends of cap member 14. Clips 18 are press fitted onto end legs 22 and each clip includes a barb (not illustrated) that functions to securely retain the clip on its associated cap member end leg 22. Clips 18 include outwardly and upwardly inclined flat tabs or fingers 26. As illustrated in FIG. 3, when the cap member 14 is inserted into the picket member 12, end legs 22 flex inwardly (the degree of flexure being exaggerated for emphasis) while tabs 26 frictionally engage the inner surfaces 28 of the opposite end walls 30 of the picket member 12 in order to retain the cap member on the picket member. At present, the cap member 14 of a clip-on type picket fence cap assembly constructed generally in accordance with that shown in FIGS. 2 AND 3 can be extracted from picket member 12 with about 15 lbs. of pulling force or less.

Figure 4:
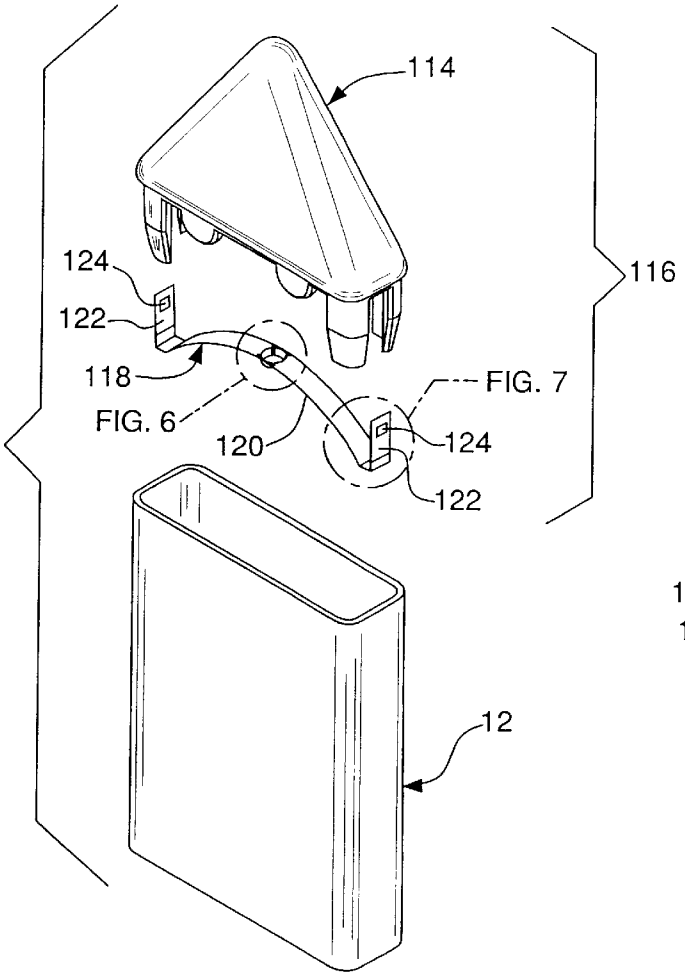
FIG. 4 is an exploded isometric view of a plastic picket and a clip-on picket fence cap assembly according to the present invention.

FIG. 4 is an exploded isometric view of a plastic picket 12 and a clip-on picket fence cap assembly 116 according to the present invention. Assembly 116 preferably comprises a molded plastic cap member 114 that is affixable to an extruded plastic picket member 12 via a metal clip 118. Clip 118 is desirably fabricated from stainless steel or other corrosion-resistant metal or metal alloy. According to a presently preferred embodiment, clip 118 is constructed as a bow-like member including an upwardly bowed central portion 120 that is joined to first and second upwardly extending end portions 122 that are preferably provided with at least one outwardly projecting retention means 124. The bow-shaped central portion 120 exerts outward force on the end portions to cause the retention means 122 to securely embed into the inner end wall surfaces of picket member 12 when the cap assembly 116 is inserted therein.

Figure 6:
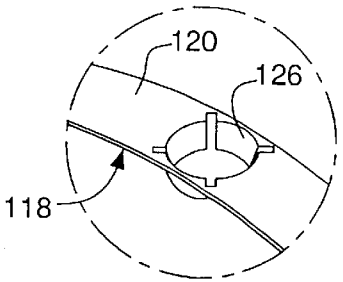
FIG. 6 is an enlarged view of a portion of a clip of the clip-on picket fence cap assembly according to the present invention.
Figure 7:
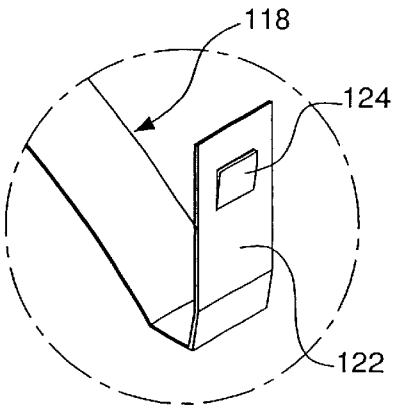
FIG. 7 is an enlarged view of another portion of a clip of the clip-on picket fence cap assembly according to the present invention.

Details of the presently preferred embodiment of clip 118 are shown in FIGS. 6 and 7. As shown in FIG. 6, central portion 120 of clip 118 preferably includes gripping means 126 for tightly retaining a post member 128 (FIG. 5) that is created as part of the molding process of cap member 114, the construction of which is described hereinafter. Gripping means 126 may assume any sort of configuration that produces one or more barbs or similar means that may be easily formed into the clip during its manufacture. According to a preferred embodiment, gripping means 126 is a plurality of flap-like barbs that are stamped from the central portion 120. Similarly, retention means 124 are preferably constructed as at least one outwardly projecting barb that is stamped from the material of the end portions 122 of clip 118.

Figure 5:
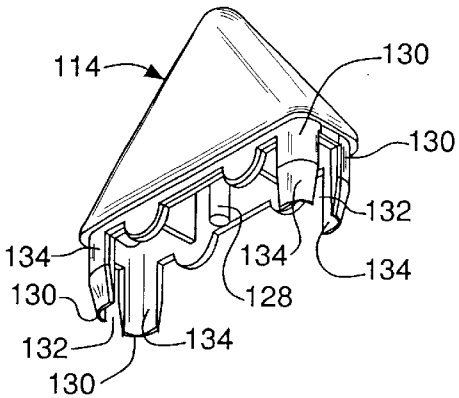
FIG. 5 is an isometric view of the cap member of the clip-on picket fence cap assembly according to the present invention.

As most clearly depicted in FIG. 5, cap member 114 includes, in addition to post member 128, end legs 130 downwardly depending from each end of the top or finial portion of the cap member. The end legs 130 are separated by end wall gaps 132 that are dimensioned to closely receive the upwardly extending end portions 122 of clip 118. To attach the cap member 114 to the clip 118, the post member is first aligned with the clip such that the end wall gaps 132 are in alignment with the end portions 122 of clip 118. The post member 128 is then inserted into the gripping means 126 of the clip 118 until the gripping means become firmly embedded in the post member to securely connect the cap member 114 to the clip. The interconnection between post member 128 and gripping means 126 cooperate to function as means for resisting inward flexure of end portions 122 of clip 118. Indeed, the end legs 130 and the compression of the post member 128 on the central portion exert outward force against the end portions 122 of the clip 118. The connected assembly 116 is then inserted into the open top of picket member 12 until the base of the top portion of the cap member comes to rest on the upper edge of the picket member. When assembly 116 is installed on the picket member 12, the outward force exerted on the end portions 122 of the clip 118 urge the retention means 124 into tight embedded engagement with the inner end walls of the picket member.

As also shown in FIG. 5, the end legs 130 of cap member 114 additionally preferably include side extensions 134 that resist deflection of the end legs when inserted in the picket member 12. Side extensions 134 resist inward flexure of the end legs 130 when the cap assembly 116 is inserted into the picket 12. This structural feature further force the barbs of retention means 124 of the end portions of clip 118 into secure "hooking" or "biting" engagement into the inner walls of the extruded picket.

From the foregoing, it will be appreciated that the resultant picket fence cap assembly 116 of the present invention is substantially stiffer and stronger than clip-on picket fence cap assembly 16 of FIGS. 2 AND 3. Because of this, clip 118 very firmly embeds itself into picket member 12 and make it very difficult to extract the cap member 114 from the picket member by simply pulling on the cap member.

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. A cap assembly for a hollow plastic fence picket member, said assembly comprising:

a plastic cap member including a top portion and end legs downwardly depending from said top portion and adapted for insertion into a picket member; and a clip including a central portion upwardly bowed toward said top portion of said cap member, said central portion being joined to first and second upwardly extending end portions, said end portions having outwardly projecting retention means for contacting inner surfaces of end walls of a picket member when the cap assembly is inserted therein.

2. The cap assembly of claim 1 wherein said clip is fabricated from metal.

3. The cap assembly of claim 1 further comprising means for resisting inward flexure of said end portions of said end legs.

4. The cap assembly of claim 1 wherein said retention means comprises at least barb.

5. The cap assembly of claim 3 wherein said means for resisting inward flexure of said end portions of said end legs comprise means for connecting said clip to said cap member.

6. The cap assembly of claim 5 wherein said cap member includes a post and said means for connecting said clip to said cap member comprise means carried by said clip for gripping said post.

7. The cap assembly of claim 6 wherein said gripping means are disposed at said central portion of said clip.

8. The cap assembly of claim 1 further comprising means for resisting inward flexure of said end legs.

9. A plastic fence picket comprising:

a hollow plastic fence picket member; and a cap assembly for said picket member comprising:

a plastic cap member including a top portion and end legs downwardly depending from said top portion and adapted for insertion into a picket member; and a clip including a central portion upwardly bowed toward said top portion of said cap member, said central portion joined to first and second upwardly extending end portions, said end portions having outwardly projecting retention means for contacting inner surfaces of end walls of a picket member when the cap assembly is inserted therein.

10. The picket of claim 9 wherein said clip is fabricated from metal.

11. The picket of claim 9 further comprising means for resisting inward flexure of said end portions of said end legs.

12. The picket of claim 9 wherein said retention means comprises at least barb.

13. The picket of claim 11 wherein said means for resisting inward flexure of said end portions of said end legs comprise means for connecting said clip to said cap member.

14. The picket of claim 13 wherein said cap member includes a post and said means for connecting said clip to said cap member comprise means carried by said clip for gripping said post.

15. The picket of claim 14 wherein said gripping means are disposed at said central portion of said clip.

16. The picket of claim 9 further comprising means for resisting inward flexure of said end legs.

17. A plastic cap member for a hollow plastic fence picket, said cap member comprising:

a top portion;

end legs downwardly depending from said top portion and adapted for insertion into the fence picket, wherein said end legs are adapted to carry a clip having a central portion joined to end portions, and wherein the end portions of the clip are adapted to contact inner surfaces of end walls of the fence picket when said end legs are inserted therein; and means for resisting inward flexure of the end portions of the clip, wherein said means for resisting inward flexure is separate from said end legs and is adapted to contact the central portion of the clip.

18. The cap member of claim 17 wherein said means for resisting inward flexure comprise a post member.

19. The cap member of claim 17 further comprising means for resisting inward flexure of said end legs.

20. In a cap assembly for a hollow plastic fence picket member, the assembly comprising a plastic cap member including a top portion and end legs downwardly depending from said top portion and adapted for insertion into the picket member, a clip adapted to be carried by the end legs and comprising:

a central portion upwardly bowed toward the top portion of the cap member; and first and second upwardly extending end portions joined to said central portion, said end portions having outwardly projecting retention means for contacting inner surfaces of end walls of a picket member when the cap assembly is inserted therein.

21. The clip of claim 20 wherein said clip is fabricated from metal.

22. The clip of claim 20 further comprising means carried by said clip for connecting said clip to said cap member.

23. The clip of claim 24 wherein the cap member includes a post and said means for connecting said clip to said cap member comprise means carried by said clip for gripping said post.

24. The clip of claim 23 wherein said gripping means are disposed at said central portion of said clip.

* * * * *